US009637843B2

(12) United States Patent
Kunisada et al.

(10) Patent No.: US 9,637,843 B2
(45) Date of Patent: May 2, 2017

(54) FABRIC MATERIAL

(71) Applicant: TOYOTA BOSHOKU KABUSHIKI KAISHA, Aichi-ken (JP)

(72) Inventors: Hideaki Kunisada, Aichi-ken (JP); Yoshiteru Honma, Aichi-ken (JP); Hiroki Kashima, Aichi-ken (JP); Miki Imai, Aichi-ken (JP); Tatsuro Shinozaki, Aichi-ken (JP); Masako Furuta, Aichi-ken (JP)

(73) Assignee: TOYOTA BOSHOKU KABUSHIKI KAISHA, Aichi-Ken (JP)

( * ) Notice: Subject to any disclaimer, the term of this patent is extended or adjusted under 35 U.S.C. 154(b) by 191 days.

(21) Appl. No.: 13/911,342

(22) Filed: Jun. 6, 2013

(65) Prior Publication Data

US 2014/0363656 A1 Dec. 11, 2014

(51) Int. Cl.
*D02G 3/44* (2006.01)

(52) U.S. Cl.
CPC ..... *D02G 3/441* (2013.01); *D10B 2505/08* (2013.01); *Y10T 428/249921* (2015.04)

(58) Field of Classification Search
USPC ..... 148/402, 559; 428/220, 544, 221; 57/210
See application file for complete search history.

(56) References Cited

U.S. PATENT DOCUMENTS

| | | | | |
|---|---|---|---|---|
| 5,927,060 | A | 7/1999 | Watson | |
| 2010/0075168 | A1* | 3/2010 | Schaffer | 428/544 |

FOREIGN PATENT DOCUMENTS

| | | |
|---|---|---|
| CN | 1526032 | 9/2004 |
| CN | 1993776 | 7/2007 |
| CN | 102251328 | 11/2011 |
| CN | 102364987 | 2/2012 |
| JP | 63-125614 | 5/1988 |
| JP | 6-346146 | 12/1994 |
| JP | 9-170017 | 6/1997 |
| JP | 2002-313543 | 10/2002 |
| JP | 2004-281241 | 10/2004 |
| JP | 2008-184643 | 8/2008 |
| JP | 2012-248495 | 12/2012 |
| WO | 96/37122 | 11/1996 |

OTHER PUBLICATIONS

Japanese Office Action for JP App. No. 2011-278392 issued Jun. 2, 2015, along with English-language translation thereof.
Official Action, including a partial English-language translation thereof, for CN Pat. App. No. 201310228742.5 having an issuance date of Oct. 16, 2015.

* cited by examiner

*Primary Examiner* — Lynda Salvatore
(74) *Attorney, Agent, or Firm* — Greenblum & Bernstein, P.L.C.

(57) ABSTRACT

A stainless wire that does not have a crystal grain of 200 nm or greater in maximum length in a surface normal to a fiber axis within a range of 1 μm square from a center of a diameter in a cross section normal to a fiber axial direction is used as the stainless wire that forms a fabric material.

8 Claims, 4 Drawing Sheets

FABRIC MATERIAL

BACKGROUND OF THE INVENTION

1. Field of the Invention

The present invention relates to fabric materials and more particularly to a conductive fabric with high flex resistance.

2. Description of Related Art

The conductive fabric provided with a conductive yarn capable of passing electric current in the fabric is used to provide a heater, a sensor, or an antenna or the like integrally formed in or with the fabric such as woven fabric, knitted fabric, and nonwoven fabric. For example, U.S. Pat. No. 5,927,060 discloses the conductive yarn referred to as a covered yarn that includes a polyester core yarn spirally wrapped with metal wires. A stainless steel wire is preferably used as the metal wire in such conductive yarn because the stainless wire has high tensile strength and corrosion resistance in comparison with other metal wires.

The conductive fabric is bent into various shapes in use. When the conductive fabric is used as a seat material of a vehicle seat which includes a heater and a pressure sensor, for example, a passenger repeatedly sits on and stands up from the conductive fabric or moves the buttocks in various directions with being seated. At this time, the conductive fabric is bent in upward and downward directions, forward and backward directions, and in various directions. In a case where the conductive fabric is used as clothing, the conductive fabric is bent through movements of a body during the donning and doffing processes or under wearing conditions. The metal wire forming the conductive fabric has a small diameter, and therefore when the metal wire is repeatedly bent, a break in the metal wire may occur due to metal fatigue. In the case of the break in the metal wire, electrical resistivity increases at the break, and the functions of the conductive fabric are impaired. When the metal wire breaks during the passage of electric current, the electrical resistivity may increase without user being aware of the break, and a sudden temperature rise may occur. In addition, the break in the metal wire may occur not only during the use of the conductive fabric but also in dyeing processes. This is because the fabric needs to be strongly rubbed during the dyeing processes. As described above, if there is a possibility that the metal wire breaks in the dyeing processes or under usage conditions, the conductive fabric may become unreliable.

SUMMARY OF THE INVENTION

The present invention provides a fabric material that includes a metal wire and has electrical conductivity. Further, the fabric material has high flex resistance, prevents the metal wire from breaking in the case of experiencing repeated bending in the dyeing processes or under usage conditions, and has high reliability.

The fabric material according to one aspect of the present invention includes: a stainless wire that does not have a crystal grain of 200 nm or greater in maximum length in a surface normal to a fiber axis within a range of 1 μm square from a center of a diameter in a cross section normal to a fiber axial direction; and a nonconductive yarn.

The stainless wire may be made of austenitic stainless steel. In addition, the fabric material may be used for a seat material of a vehicle seat.

The fabric material according to the above aspect has electrical conductivity by including the stainless wire. Because the crystal grain of 200 nm or greater in the maximum length in a surface normal to a fiber axis does not exist in a specified range in the stainless wire, microcracks are hardly produced in a boundary of large crystal grains. Accordingly, even if the fabric material including the stainless wire repeatedly experiences the bending in the dyeing processes or under usage conditions, the occurrence of the break in the stainless wire can be reduced greatly in comparison with the case of the conventional common conductive fabric material. Therefore, the reliability with regard to electrical characteristics of the fabric material increases.

When the stainless wire is made up of austenitic stainless steel, the stainless steel can easily be thinned because the austenitic stainless steel generally has high ductility and toughness. In addition, the strength of the austenitic stainless steel can highly increase through cold working. The cooling in the cold working is required to be enhanced for reducing the grain size of the crystal grain existing in the stainless wire in order to prevent the break during bending; however, high-strength stainless wire can be obtained through the cold working because of such characteristics of the austenitic stainless steel. Thus, the fabric material using the stainless wire made of the austenitic stainless steel possesses high strength.

BRIEF DESCRIPTION OF THE DRAWINGS

Features, advantages, and technical and industrial significance of exemplary embodiments of the invention will be described below with reference to the accompanying drawings, in which like numerals denote like elements, and wherein.

DETAILED DESCRIPTION OF EMBODIMENTS

Hereinafter, the fabric material according to one embodiment of the present invention will be described in detail. The fabric material according to the present invention includes a conductive yarn having electrical conductivity and a nonconductive yarn not having electrical conductivity. The fabric material is a conductive fabric having electrical conductivity. The conductive yarn and the nonconductive yarn can be used to form various conductive fabrics such as woven fabric, knitted fabric, and nonwoven fabric. For example, when the woven fabric is formed, the conductive yarn can be used for a part of the warp or the weft to obtain the fabric having electrical conductivity.

Figure 1:
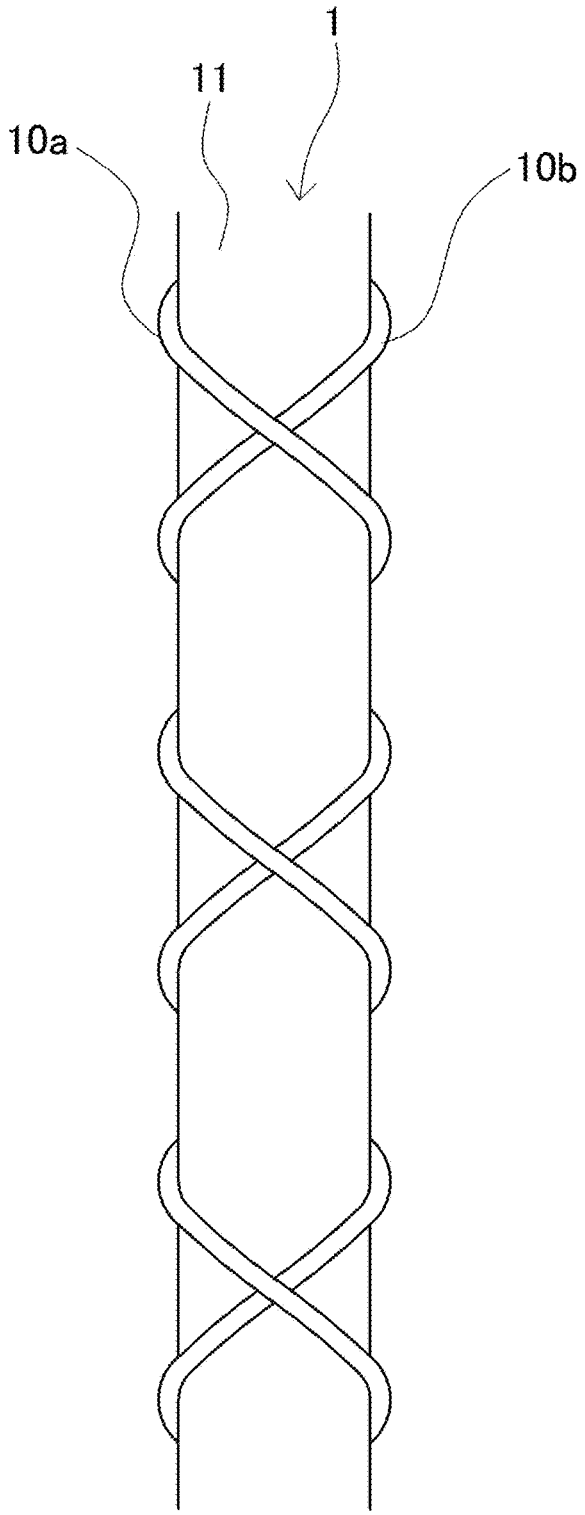
FIG. 1 is a diagram that shows a structure of a conductive yarn forming a fabric material according to one embodiment of the present invention.

FIG. 1 shows one example of the structure of the conductive yarn forming the conductive fabric. The conductive yarn 1 has the structure of the covered yarn in which twisted stainless wires 10*a* and 10*b* as covering yarns are spirally wrapped around a core yarn 11 made up of the nonconductive yarn. Adopting such a covered structure prevents the break in the twisted stainless wires 10*a* and 10*b* because even when the force causing the elongation of the conductive yarn 1 is applied in the fiber axial direction of the core yarn 11, the force is not applied in the fiber axial direction of a twisted stainless wire 10*a* and 10*b*.

The twisted stainless wire 10*a* and 10*b* is constructed by twisting a plurality of stainless wires (element wires). When the diameter of the stainless wire is too small, the tensile strength may be insufficient. Therefore, the diameter of the stainless steel wire is preferably 10 μm or greater, more preferably 14 μm or greater, and particularly preferably 16 μm or greater. On the other hand, when the wire diameter is too large, the difference in the curvature inside and outside a bending point becomes large at the time of bending, and a crack is produced between the inside and the outside, and therefore bending durability may decrease. Specifically, the diameter of the stainless steel wire is preferably 35 μm or smaller, more preferably 28 μm or smaller, and particularly preferably 23 μm or smaller.

Although any stainless steels can be selected as the stainless material that forms the stainless wire, particularly austenitic stainless steel is preferably used. This is because the austenitic stainless steel has high ductility and toughness and thus can be thinned easily. The strength of the austenitic stainless steel highly increases through cold working. Therefore, it is preferable that the austenitic stainless steel be used in that high strength material can be obtained when cooling in the cold working is enhanced in order to finely grain the structure as described below. The austenitic stainless steel of SUS304 expressed with schematic composition of 18Cr-8Ni, SUS316 expressed with schematic composition of 18Cr-12Ni-2Mo, or their derivatives such as SUS316L is preferably used in terms of their excellent corrosion resistance. Among those stainless steels, SUS316 or its derivative having specifically higher corrosion resistance is particularly preferably used.

In order to increase the flex resistance of the conductive fabric including the stainless wire, it is required that the stainless wire itself as the element wire has high flex resistance and does not break when the stainless wire is bent. The most important parameter for reducing the break in the stainless wire is a grain size of crystal grains of stainless steel in the stainless wire. It is necessary not to have the crystal grain of 200 nm or greater in the maximum length in a surface normal to a fiber axis (hereinafter, may be referred to as grain size) within the range of 1 μm square from the center of the wire diameter when the cross section normal to the fiber axial direction of the stainless wire is observed. This is because microcracks are produced in a grain boundary between such a crystal grain and an adjacent crystal grain and result in fatigue failure if large crystal grain of 200 nm or greater in the maximum length in the surface normal to the fiber axis exists in the region. The fatigue failure causes the break in the stainless wire. The maximum length in the surface normal to the fiber axis for some crystal grain means the maximum length from an arbitrary point on the outer edge of the crystal grain to another point on the outer edge when the cross section normal to the fiber axis is observed.

In general, the grain size of the crystal grain in the stainless wire is affected by the history of temperature changes during manufacturing process. As described below, the grain size of the crystal grain to be produced depends on the degree and the speed of cooling. When the cooling is slow, the crystal growth proceeds and large crystal grain is produced. Accordingly, the vicinity of the center of the wire diameter where cooling rate is slow has higher possibility of producing the large crystal grain than an outside region where the cooling rate is fast. In other words, it can be determined that when the crystal grain in a certain size or larger does not exist in the vicinity of the center, such crystal grain does not exist in the outside region, either. On this account, the region where the crystal grain size is evaluated is designated in a region of 1 μm square from the center of the wire diameter.

Even if a small number of the crystal grains in large grain size exist in the region of 1 μm square from the center of the wire diameter, the microcracks are produced in the metal structure. Therefore, it is important that the crystal grain in grain size of 200 nm or greater does not exist even if the number of the crystal grain is small. No matter how small the average grain size of all crystal grains is, even if a small number of the crystal grain in grain size of 200 nm or greater exists, it can be considered that cracks are produced at the point. Accordingly, the average grain size is not an important parameter for the flex resistance of the stainless wire in comparison with the upper limit of the grain size. As described below, the grain size of the crystal grain forming the stainless wire largely depends on processing temperature in the manufacturing method of the wire, particularly in a wire drawing process; however, no variation occurs in the crystal grain size in the vicinity of the surface of the wire where the cooling proceeds quickly even though the type of the stainless wire differs. On the other hand, the grain size of the crystal grain in the vicinity of the center of the wire diameter largely varies by the type of the stainless wire. Therefore, the stainless wire having high flex resistance can be obtained by specifying the grain size of the crystal grain within the range of 1 μm square from the center of the wire diameter in the cross section normal to the fiber axial direction.

The formation of the stainless wire that does not have the crystal grain of 200 nm or greater in the maximum length in the surface normal to the fiber axis within the range of 1 μm square from the center of the wire diameter as described above can be achieved by enhancing the cooling through the cold working when a bus wire of about 80 μm in diameter is thinned through the wire drawing process. This is because recrystallization proceeds and the crystal grain largely grows when the stainless wire is heated to high temperature during the working; however, the crystal growth can be inhibited by enhancing the cooling. As described above, because the strength of the austenitic stainless steel highly increases through cold working, a high-strength stainless wire can be obtained by enhancing the cooling and drawing the wire through the cold working.

A technique for observing the cross section of the stainless wire and evaluating the crystal grain size may be achieved by means of any microscopes such as a scanning electron microscope (SEM), a transmission electron microscope (TEM), and a scanning transmission electron microscope (STEM), as long as the microscope can make observation of the crystal grain having the grain size of the order of 10 to 100 nm with sufficient resolution. A dark-field scanning transmission electron microscope (DF-STEM) is preferably used for the observation of the material strongly scattering electron beam like a metal in the technical aspects of easily performing an accurate grain size evaluation of the crystal grain.

When the aforementioned, stainless wire is used as the covering yarn for the covered yarn, the stainless wire is preferably formed as the twisted wire in which the element wires are twisted. There is no particular restriction on twist pitch length; however, it is desirable for the twist pitch length to be 0.5 mm or greater and 2 mm or smaller. The number of the twisted wires in the structure depends on thickness of the element wire to be used or desired electrical resistivity; however it is desirable for the number of the twisted wires to be selected such that the element wires are arranged in close packing in order to stabilize the arrangement among the element wires and obtain high strength. The close packing means a state in which the element wires in the largest number circumscribe one element wire located in the center, and in the case where all element wires have the same diameter, seven element wires are arranged.

The nonconductive yarn forming the core yarn of the covered yarn may be any nonconductive natural fibers or synthetic fibers. Among those fibers, a polyester fiber such as polyethylene terephthalate (PET) having high durability is preferably used.

There is no particular restriction on twist count when the covering yarn formed with the stainless wire is wrapped around the nonconductive core yarn; however, the twist count can be set to 50 to 1,000 T/m. In addition, the covered yarn may be either a double-covered yarn in which two conductive yarns are wrapped as shown in FIG. 1 or a single-covered yarn in which one conductive yarn is wrapped. There is no restriction on a twisting direction, and the twisting direction may be either S-twist or Z-twist.

In order to prevent the stainless material from being electrolyzed and corroded when the stainless material is immersed in salt water, it is desirable that the conductive yarn be coated with resin. There is no particular restriction on the resin material; however, the resin material having high adhesion to the stainless wire, heat resistance, and cold resistance is preferably used. Specifically, the resin material can include, for example, vinyl chlorides, polyurethanes, fluorocarbon resin, and acrylic. The conductive yarn may be impregnated with such resins in a liquid state, and the resin may be solidified.

Hereinafter, the present invention will be described in detail with the following examples.

An SUS316 element wire of 18 μm in diameter (manufactured by ASAHI INTECC CO., LTD.) was prepared as a stainless wire of Embodiment 1. The stainless wire was manufactured by enhancing the cooling in the wire drawing process through the cold working in comparison with the conventional common stainless wire.

Embodiment 2 will be described hereinafter. A twisted stainless wire was formed by twisting seven stainless wires of Embodiment 1 with the twist count of 1,500 T/m. The covered yarn was produced with a polyethylene terephthalate (PET) temporary twisted yarn of 330 dtex-72 filament as the core yarn and by wrapping two twisted stainless yarn in the S-twist direction and the Z-twist direction respectively with the pitch of 500 T/m. The covered yarn was woven as a part of the weft (in the proportion of 1 yarn per 2 cm), and the conductive fabric was produced. The PET yarn was used for other weft and warp. The woven fabric had side double system, and the covered yarn as the conductive yarn was arranged on the back side of the fabric so as not to appear on the front side.

Embodiment 3 will be described hereinafter. The conductive fabric of Embodiment 2 was used to produce a seat material forming the vehicle seat. First, a backing agent was applied on the back side of the conductive fabric of Embodiment 2 and dried. The backing agent containing an acrylic polymer synthesized from butylacrylate and acrylonitrile and a flame retardant as major ingredients was used. Furthermore, a pad material of a polyurethane sheet (5 mm in thickness) and a fabric backing with half tricot (15 dtex Nylon 6) were arranged and then formed in one body by flame lamination. Next, the fabric material was cut with specified dimensions of a seating surface of the seat. The polyurethane sheet, the fabric backing, a resin layer of the backing agent, and the PET yarn were removed from a section where the passage of electric current is required for use as a heater in sewing sections by means of laser, and then, a belt in which a copper wire plated with tin was used in the warp was sewed as a connecting member in the exposed stainless wire. A plurality of conductive wires (stainless wires) were electrically connected in parallel by a pair of energization means, and therefore a parallel circuit of the conductive wires was formed in the fabric material.

A different SUS316 element wire of 18 μm in diameter from Embodiment 1 (manufactured by FURUKAWA MAGNET WIRE CO., LTD.) was prepared as a stainless wire of Comparative Embodiment 1. This stainless wire was produced through the same manufacturing method as the conventional common stainless wire, and the cooling in the wire drawing process through the cold working was not enhanced as that of Embodiment 1.

The conductive fabric associated with Comparative Embodiment 2 was produced by using the stainless wire according to Comparative Embodiment 1 through the method similar to Embodiment 2.

The seat material associated with Comparative Embodiment 3 was produced by using the conductive fabric according to Comparative Embodiment 2 through the method similar to Embodiment 3.

A test method for evaluating the crystal grain size in the cross section of the stainless wire will be described hereinafter. Thin samples of the stainless wires according to Embodiment 1 and Comparative Embodiment 1 were obtained through a microsampling method using focused ion beam such that the cross section was determined in the direction normal to the fiber axis. The DF-STEM observations were made for those samples by using a field-emission transmission electron microscope (JEM-2100F manufactured by JEOL Ltd.). After entire cross section was observed at low magnification, close observation was made for the vicinity of the center of the diameter and the vicinity of the surface at high magnification.

A bending test of the conductive fabric will be described hereinafter. The bending tests of the conductive fabrics according to Embodiment 2 and Comparative Embodiment 2 were conducted in conformity with the JIS C 1010-31 standard. The conductive fabrics according to Embodiment 2 and Comparative Embodiment 2 were cut in strips with a width of 30 mm and a length of 200 mm. At this time, the conductive fabrics were cut so that the conductive yarns were arranged in the center of the width direction. The conductive yarns were drawn from the ends of the strip so that electric current could be applied.

The middle position in the length direction of the strip conductive fabric was supported between acrylic rods of 1 mm in diameter from the front and the back sides and determined to be a bending support. An end of the strip conductive fabric was held with a clamp jig and arranged such that the conductive fabric could be moved from side to side at an angle of 60° on one side, that is, total of 120° in the thickness directions (forward and backward directions) of the fabric around the bending support. The 120° movement in either of the forward or the backward direction was considered as one bending, and the strip conductive fabric was bent at the rate of 100 times per minute. The bending test was conducted while electric current was applied to the conductive fabric and the electrical resistivity was measured. The break in the stainless wire was detected by tracking the change in the resistivity, and the number of bending in which the first one of stainless element wires forming the conductive fabric broke was recorded.

A tensile test of the stainless wire will be described hereinafter. Ends of the stainless wires (element wires) according to Embodiment 1 and Comparative Embodiment 1 were held with the clamp jig, and forces were applied to pull the wire in the directions in which the ends were spaced apart. At this time, the test was conducted while electric current was applied to the stainless wire and the electrical resistivity was measured. The break in the stainless wire was detected by tracking the change in the resistivity, and the tensile strength and the fracture elongation at that time were recorded.

A loading and unloading durability test of the seat material will be described hereinafter. One example of human movements on the vehicle seat (upward and downward movements, forward and backward movements, and twisting movements) was reproduced for the seat materials according to Embodiment 3 and Comparative Embodiment 3 by means of a robot provided with a buttock model. Specifically, the buttock model (sitting buttock width: 39 cm) was placed on the energized seat materials in an environment of 20° C., and a load of 77 kg was applied on the buttock model. The upward and downward movements (50 mm), the forward and backward movements (30 mm), and the twisting movements (15°) of the buttock model were repeated on the seat materials in this order for 500,000 times. The electric current was applied to the seat materials after the testing, and after a lapse of five minutes from the energization, it was checked by means of a thermal camera whether there was an occurrence point of aberrant heating in which the temperature increased to 5° C. or higher than the initial state or whether there was the heater wire in which the temperature did not increase due to the break.

Figure 2A:
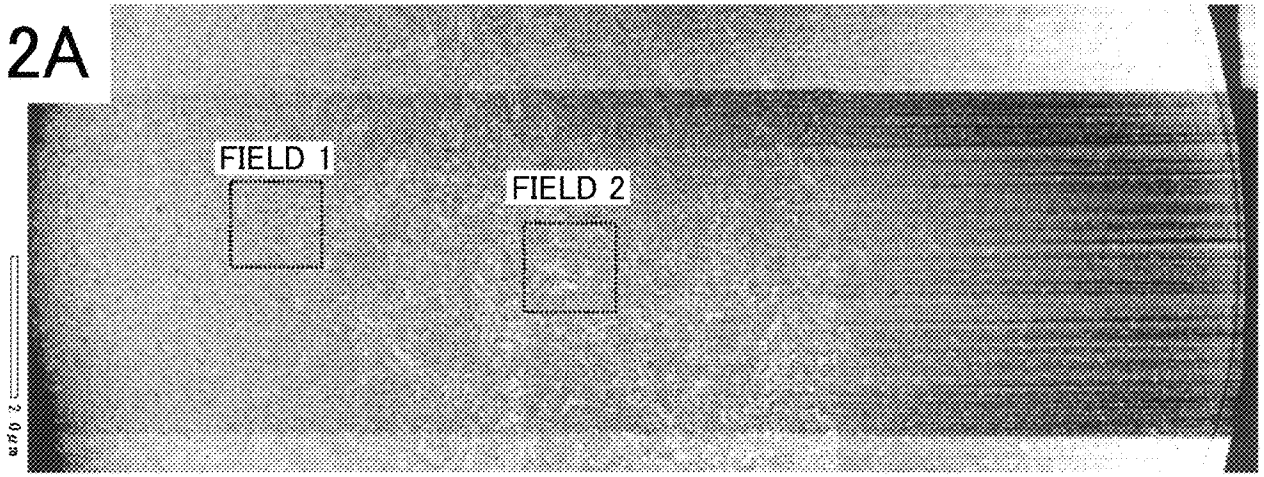
FIG. 2A is a DF-STEM image of a cross section normal to a fiber axial direction of a stainless wire according to Embodiment 1.
Figure 2B:
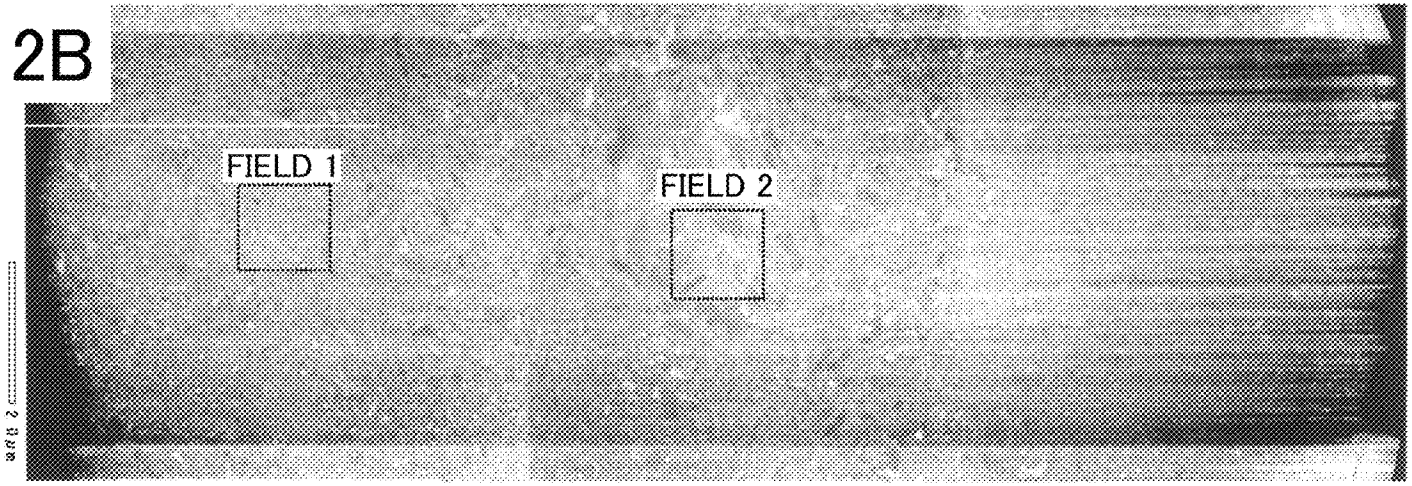
FIG. 2B is a DF-STEM image of a cross section normal to the fiber axial direction of a stainless wire according to Comparative Embodiment 1.

The test results will be described and discussed below. FIG. 2A and FIG. 2B show the DF-STEM images of the stainless wires according to Embodiment 1 and Comparative Embodiment 1 at low magnification with regard to the evaluation of the crystal grain size in the cross section of the stainless wire. The observation is made for entire width in the radial direction, and the arc shape in the ends of the image corresponds to the outer edge of the wire. When these images are compared, the vicinity of the surface of the wire has relatively uniform fine grain structure in the stainless wire according to Comparative Embodiment 1, whereas a rough structure is observed in an inner region of the wire. On the other hand, the stainless wire according to Embodiment 1 has relatively uniform fine grain structure in the vicinity of the surface and the inside.

In order to examine the difference in size of such structures in detail, the observation under magnification was made for Field 1 in the vicinity of the surface and Field 2 including the center in the radial direction in FIG. 2A and FIG. 2B. The results of those observations are shown in FIG. 3A, FIG. 3B, FIG. 4A, and FIG. 4B. The observations for Field 1 and Field 2 are respectively made for the range of about 130 μm square.

Figure 3A:
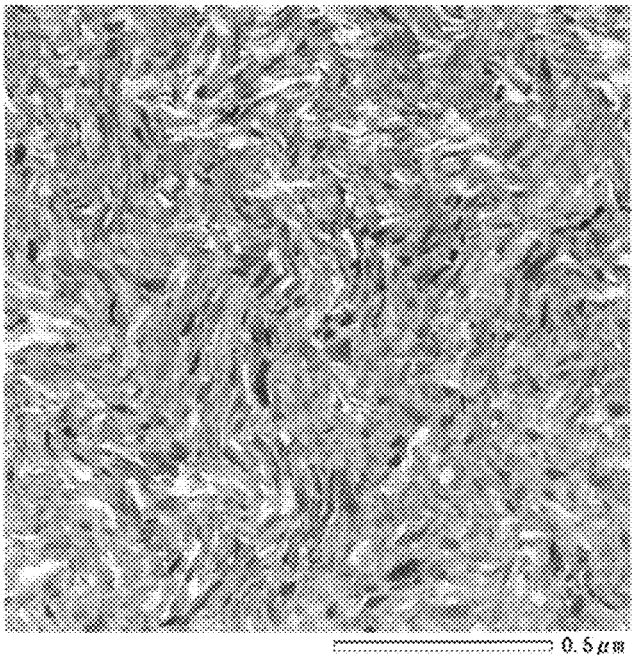
FIG. 3A is a DF-STEM image of Field 1 in FIG. 2A at higher magnification.

In FIG. 3A showing the DF-STEM image of the vicinity of the surface of the stainless wire (Field 1) according to Embodiment 1, it is observed that plate-like crystal grain is formed and the thickness direction of the crystal grain is oriented in a direction toward the observing surface, that is, the direction normal to the fiber axial direction. The plate-like crystal grains are arranged in waves having undulations in the observing surface. The grain size of the crystal grain is uniform in comparison with the grain size of Comparative Embodiment 1 described later or internal grain size of Embodiment 1. The maximum length of the largest crystal grain in the surface normal to the fiber axis is about 30 nm.

Figure 3B:
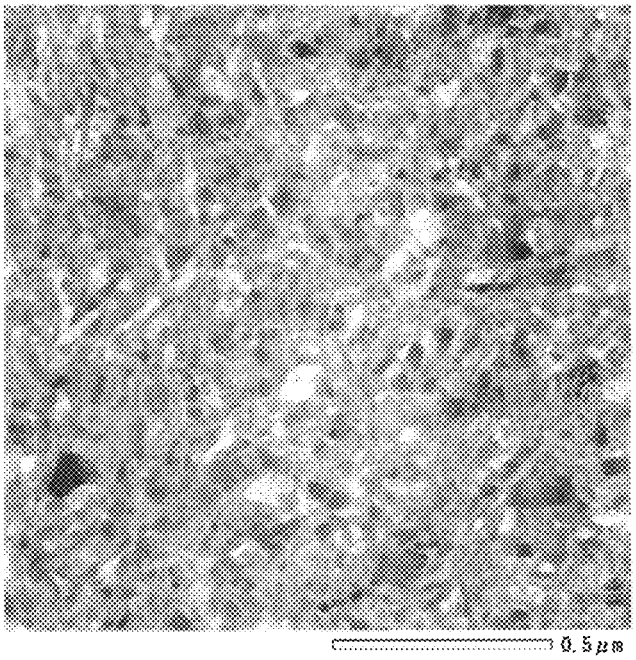
FIG. 3B is a DF-STEM image of Field 1 in FIG. 2B at higher magnification.

In the DF-STEM image of the vicinity of the surface of the stainless wire according to Comparative Embodiment 1 in FIG. 3B, the plate-like crystal grain is also observed. However, the crystal grain does not have an array structure in wave as in the case of the stainless material according to Embodiment 1 in FIG. 3A, and the crystal grain is arranged disorderly. As described above, the array structure of the crystal grain differs from that of Embodiment 1; however, the size of the crystal grain forming the structure is not so different from that of Embodiment 1. Although the Comparative Embodiment 1 slightly exhibits a wide range of variation in the crystal grain size, the maximum length of the largest crystal grain in the surface normal to the fiber axis is about 70 nm. As described below, a large difference is observed between the stainless wire according to Embodiment 1 and the stainless wire according to Comparative Embodiment 1 when the crystal grain sizes in the vicinity of the center are compared, whereas the difference in the crystal grain sizes in the vicinity of the surface is about twice as much.

Figure 4A:
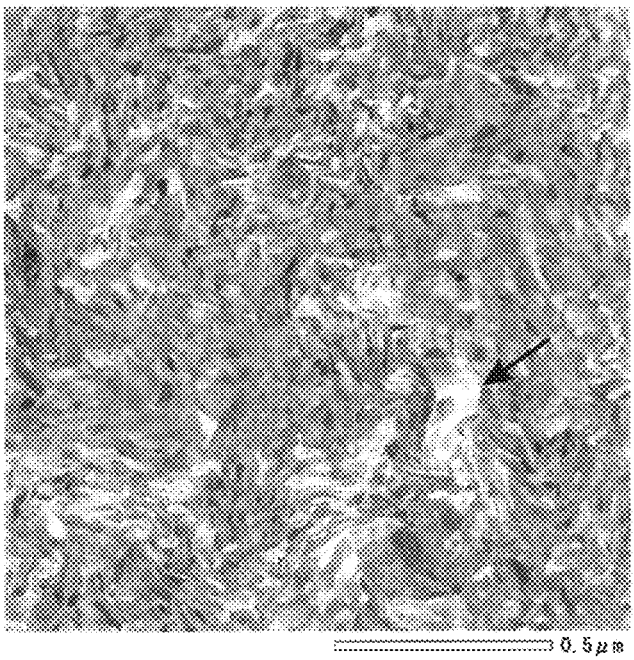
FIG. 4A is a DF-STEM image of Field 2 in FIG. 2A at higher magnification.

FIG. 4A shows the DF-STEM image in the vicinity of the center of the stainless wire (Field 2) according to Embodiment 1. Similar to the image of the vicinity of the surface in FIG. 3A, the stainless wire has the structure in which the plate-like crystal grains having the thickness direction toward the observing surface are arranged in waves. Although the number of crystal grains having larger diameter slightly increases in comparison with the case in FIG. 3A, large differences in the structures of the vicinity of the surface and the vicinity of the center cannot be recognized so much as the case of the stainless wire according to Comparative Embodiment 1 described next. In other words, as verified in the image under low magnification of FIG. 1, the vicinity of the surface and the inside of the stainless wire have relatively uniform structures. The largest crystal grain that has the maximum length in the surface normal to the fiber axis in this field is shown with an arrow in FIG. 4A, and the maximum length in the surface normal to the fiber axis is about 180 nm. In other words, the crystal grain in which the maximum length in the surface normal to the fiber axis is 200 nm or greater does not exist in the region of 1 μm square from the center of the diameter.

Figure 4B:
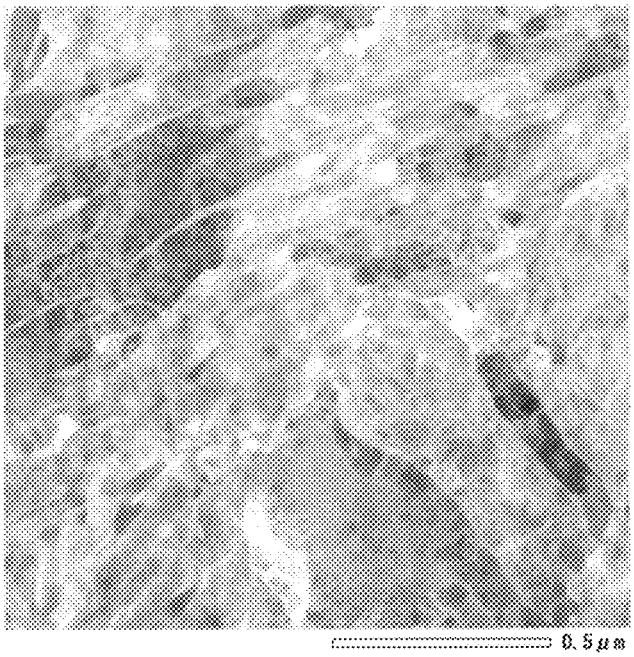
FIG. 4B is a DF-STEM image of Field 2 in FIG. 2B at higher magnification.

FIG. 4B shows the DF-STEM image in the vicinity of the center of the stainless wire (Field 2) according to Comparative Embodiment 1. Coarse crystal grains can be clearly observed in comparison with the image in the vicinity of the surface of the same stainless material as shown in FIG. 3B and the image in the vicinity of the center of the stainless wire according to Embodiment 1 in FIG. 4A. The grain size of the large crystal grain is clearly 200 nm or greater, and the large crystal grain with the maximum length in the surface normal to the fiber axis does not fit in the observing field; however, the maximum length of the largest crystal grain in the surface normal to the fiber axis is 800 nm or greater with low estimation.

Although the stainless wire is formed by drawing the base material through cold working, the crystal growth occurs through the recrystallization if the cooling during the process is not enough, and grains with large grain size are produced. On the other hand, if the cooling in the cold working is enhanced, the movement of metal atom constructing the crystal grain is restricted, and the crystal growth is inhibited. A number of cores of the crystal grain are produced by quick cooling, and a number of fine crystals are produced around the cores. When the wire is cooled, the cooling proceeds from the surface, and cooling to the vicinity of the center requires time. Because the cooling during the cold working is enhanced in Embodiment 1 in comparison with Comparative Embodiment 1, it can be considered that the crystal growth occurs in the vicinity of the center of the stainless wire of Comparative Embodiment 1 until the inside of the stainless wire is cooled, whereas the vicinity of the center of the stainless wire is quickly cooled in Embodiment 1 and therefore the crystal growth does not proceed. It can be considered that the vicinity of the surface of the stainless wire is quickly cooled in either case and therefore the crystal grain sizes are not so different from each other.

As described above, the crystal grain size of the stainless wire is evaluated with DF-STEM suitable for the estimation of the crystal grain size of the metal; however, the similar observation is made with TEM. Although the result is not described, the same results as in the case of the observation with DF-STEM can be obtained.

The results of the bending test of the conductive fiber and its consideration will be described hereinafter. According to the bending test described above, the break of the wire did not occur in the conductive fiber of Embodiment 2 after the bending of 1,000,000 cycles. On the other hand, the break was observed in the conductive fiber of Comparative Embodiment 2 for the bending of 50,000 cycles.

In other words, the conductive fiber using the stainless wire in which the crystal grain of 200 nm or greater in grain size is not observed in the region of 1 μm square from the center of the diameter has higher durability against the bending of 20-fold or greater cycles than the conductive fiber using the stainless wire in which the crystal grain of 200 nm or greater in grain size is observed in the vicinity of the center in the radial direction. As described above, it can be considered that microcracks are produced in the grain boundary of the coarse crystal grains and result in the break of the wire when the wire is bent and the bending durability is increased due to the absence of the crystal grains with large grain size in the vicinity of the center of the stainless wire.

It can be considered that bending movement of the conductive fabric used in this bending durability test in which the conductive fabric is bent to forward and backward sides about the support is similar to the bending movement in which the conductive yarn experiences during the use of the vehicle seat, the donning and doffing of clothes, and the dyeing process of the yarn. Accordingly, it can be construed that the results of this test in which high bending durability can be achieved when the crystal grain of 200 nm or greater in grain size is not observed in the vicinity of the center conforms to criteria of the bending durability required for the conductive fabric as the vehicle seat or clothes.

The results of the tensile test of the stainless wire and its consideration will be described hereinafter. The tensile strength of the stainless wire according to Embodiment 1 in which the break occurred was $3.0\times10^3$ N/mm$^2$, whereas the tensile strength of the stainless wire according to Comparative Embodiment 1 was $2.0\times10^3$ N/mm$^2$. The fracture elongations were 2.3% and 2.5%, respectively. In other words, the stainless wire according to Embodiment 1 in which the crystal grain of 200 nm or greater in grain size does not exist in the region of 1 μm square from the center has higher tensile strength than the stainless wire according to Comparative Embodiment 1 in which the crystal grain of 200 nm or greater in grain size exists.

It can be considered that the fracture during pulling of the stainless wire also occurs at the microcrack in the grain boundary of the coarse crystal grains as a starting point as in the case of the fracture during bending. Accordingly, it can be understood that large tensile strength can be obtained with regard to the stainless wire according to Embodiment 1 which does not have the crystal grain of 200 nm or greater in grain size in the region of 1 μm square from the center.

The results of the loading and unloading durability test of the seat material and its consideration will be described hereinafter. The aberrant heating section or the break in the heater wire cannot be observed in the seat material according to Embodiment 3. On the other hand, with regard to the seat material according to Comparative Embodiment 3, two out of 20 heater wires break and three out of 20 wires exhibit the aberrant heating. In other words, the seat material according to Embodiment 3 has higher loading and unloading durability than the seat material according to Comparative Embodiment 3.

All of the upward and downward movements, the forward and backward movements, and the twisting movements by the buttock model involve the bending of the conductive fabric forming the seat material. The result from this test simulating an actual usage of the conductive fabric agreed with the result from the bending test of the conductive fabric cut in strip as described above such that the conductive fabric using the stainless wire in which the crystal grain of 200 nm or greater in grain size does not exist in the region of 1 μm square from the center has higher bending durability than the conductive fabric using the stainless wire in which the crystal grain of 200 nm or greater in grain size exists. In other words, it was clearly revealed that the flex resistance required for the vehicle seat could be achieved by using for the conductive fabric the stainless wire in which the crystal grain of 200 nm or greater in grain size did not exist in the region of 1 μm square from the center.

As described above, the high flex resistance can be obtained with the conductive fabric according to the present invention using the stainless wire which does not have the crystal grain of 200 nm or greater in the maximum length in a surface normal to a fiber axis within the range of 1 μm square from the center of the diameter in the cross section normal to the fiber axial direction.

So far, although the embodiments of the present invention have been described in detail, the present invention is not limited to the embodiments described above. Various modifications are permissible without departing from the scope of the present invention. For example, the similar high flex resistance can be achieved not only in the case where the stainless wire is used in the woven fabrics but also in the case where the stainless wire is used in the fabrics having other structures such as the knitted fabrics. In addition, the stainless wire is not necessarily used as the covering yarn in the covered yarn, but may form the fabric with other modes.

What is claimed is:

1. A fabric material comprising:

a stainless wire defined by a population of crystal grains; and a nonconductive yarn, wherein each of the crystal grains in the population of crystal grains have a maximum length in a surface normal to a fiber axis within a range of 1 μm square from a center of a diameter in a cross section normal to a fiber axial direction, and the maximum length of each of the crystal grains in the population of crystal grains is less than 200 nm.

2. The fabric material according to claim 1, wherein the stainless wire is made of austenitic stainless steel.

3. The fabric material according to claim 1, wherein the fabric material is used for a seat material of a vehicle seat.

4. The fabric material according to claim 1, wherein the stainless wire has a diameter between 10 μm and 35 μm.

5. The fabric material according to claim 4, wherein the diameter of the stainless wire is between 14 μm and 28 μm.

6. The fabric material according to claim 5, wherein the diameter of the stainless wire is between 16 μm and 23 μm.

7. The fabric material according to claim 1, further comprising a resin coating.

8. The fabric material according to claim 7, wherein the resin coating includes one of vinyl chlorides, polyurethanes, fluorocarbon resin, and acrylic.

* * * * *